United States Patent [19]

Heffer

[11] Patent Number: 4,905,684

[45] Date of Patent: Mar. 6, 1990

[54] FUME PROTECTION DEVICE

[75] Inventor: George R. Heffer, Ontario, Canada

[73] Assignee: Geor-Gina Fume Protection Devices Inc., Ontario, Canada

[21] Appl. No.: 48,293

[22] Filed: May 11, 1987

Related U.S. Application Data

[63] Continuation-in-part of Ser. No. 741,167, Jun. 4, 1985, abandoned.

[51] Int. Cl.[4] ..... A62B 7/00

[52] U.S. Cl. ..... 128/202.13; 128/206.78; 128/207.12

[58] Field of Search ..... 128/202.13, 205.25, 128/205.24, 200.21, 201.22–201.29, 202.19, 202.18, 206.17, 206.27, 206.28, 206.21, 207.12

[56] References Cited

U.S. PATENT DOCUMENTS

| | | | |
|---|---|---|---|
| 94,905 | 9/1867 | Neven | 128/202.13 |
| 642,166 | 1/1900 | Sherman | 128/202.13 |
| 870,907 | 11/1907 | Anthony | 128/202.13 |
| 2,902,032 | 9/1959 | Davis | 129/202.13 |
| 4,109,509 | 9/1978 | Cramer et al. | 128/202.13 |
| 4,174,711 | 11/1979 | Laing et al. | 128/202.13 |
| 4,302,756 | 3/1982 | Holmes | 128/202.13 |
| 4,331,139 | 5/1982 | Popa | 128/202.13 |
| 4,373,522 | 2/1983 | Zien | 128/202.13 |
| 4,440,104 | 4/1984 | Werjefelt | 128/202.13 |
| 4,467,796 | 8/1984 | Beagles | 128/202.13 |
| 4,608,975 | 9/1986 | Tunnatta | 128/202.13 |
| 4,640,278 | 2/1987 | Barry | 128/206.12 |

FOREIGN PATENT DOCUMENTS 1196808 11/1985 Canada .

OTHER PUBLICATIONS

Letters and Newspaper Articles relating to instant invention.

*Primary Examiner*—Max Hindenburg
*Assistant Examiner*—K. M. Reichle
*Attorney, Agent, or Firm*—Nils H. Ljungman

[57] ABSTRACT

A fume protection device which allows a person within a room of a smoke filled building to breathe air from outside the building is disclosed. The fume protection device is comprised of a conduit in an exterior building wall in communication with outside air, having a sealing valve adapted to seal the conduit from the passage of air except when activated, so as to maintain pressure differences between the interior of the building and the exterior thereof under ordinary conditions, and one or more breathing masks and tubes, the tubes being connected at one end to an inlet port of a mask and having at another end a coupling jack being adapted to connect to the conduit and upon connection to open the sealing valve to establish communication between the outside air and the interior of the breathing mask through the conduit and the tube, and, at the same time, to establish an electrical circuit to supply electricity from a self-contained power source to a number of variously located emergency warning or other lights.

17 Claims, 6 Drawing Sheets

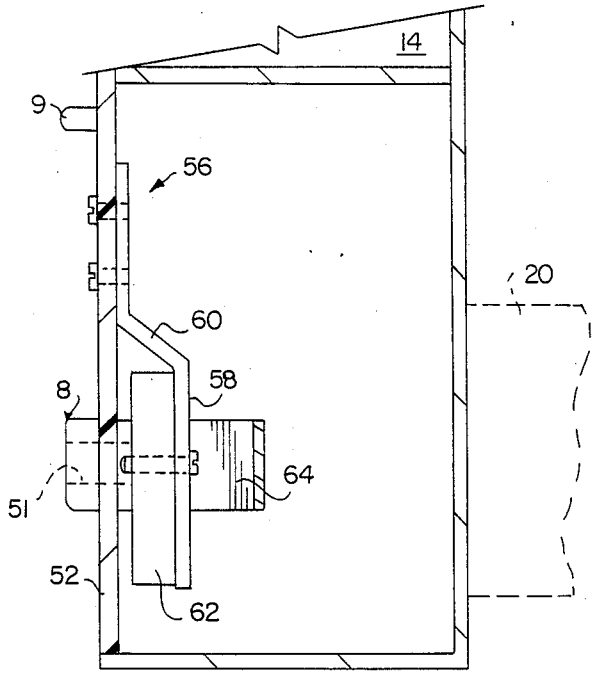
FIG. 7
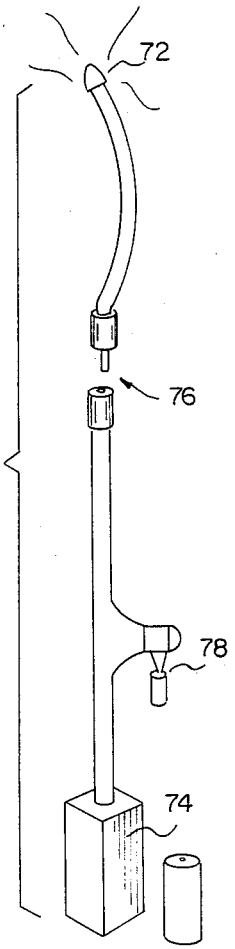
FIG. 9
FIG. 8
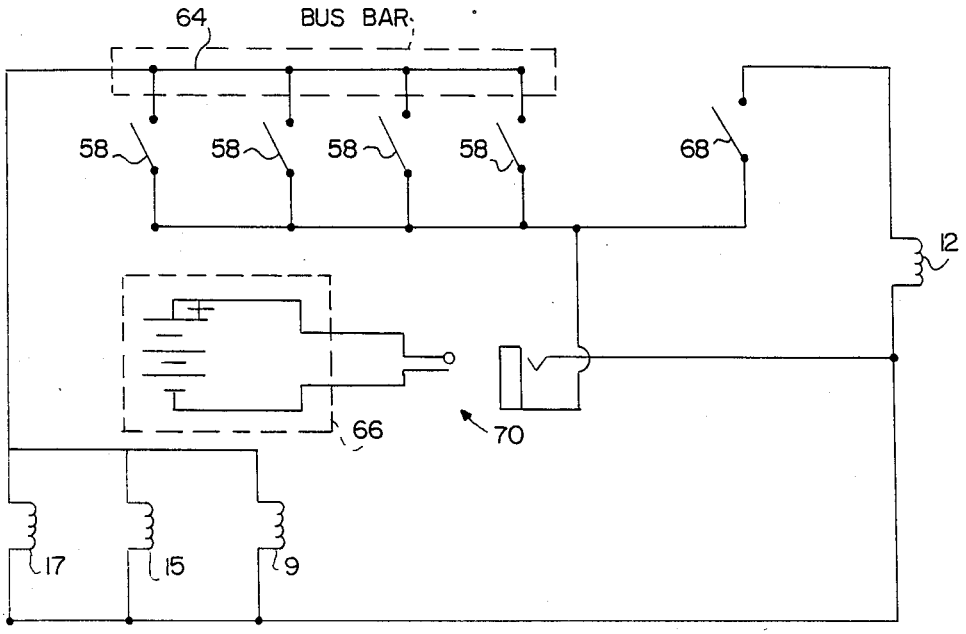

FUME PROTECTION DEVICE

CROSS-REFERENCE TO RELATED APPLICATION

This invention is a continuation-in-part of co-pending application Ser. No. 741,167, filed June 4, 1985, now abandaned.

FIELD OF THE INVENTION

This invention relates to an apparatus adapted to provide a supply of fresh filtered air to persons trapped within a burning building and unable to breathe because of toxic fumes caused by the fire.

BACKGROUND OF THE INVENTION

During the last fifty years there has been a dramatic increase in the construction of tall multi-unit hotels, office buildings and residential complexes. Typically, these buildings are constructed with a concrete and steel framework. Accordingly, if a fire begins in a unit of a building, the fire can usually be contained to the particular unit or to a floor of the building. However, the spreading of toxic fumes within the building through ventilation systems, hallways and elevator shafts is a major problem for other persons within the building. Many synthetic materials used in upholstery and rugs (for example, polyurethane) give off toxic fumes upon combustion. Such fumes mixed with the ordinary smoke of combustion can choke, suffocate or poison other individuals in the building who are trapped and blinded by the smoke and unable to escape.

Frequently, the rooms of such buildings are sealed because of air conditioning and controlled atmosphere requirements, and often there is a pressure difference between the interior of the buildings and the outside atmosphere. Accordingly, persons within a unit trying to obtain a source of fresh air may find that the only way to get outside air is to break a window, but breaking a window can create a pressure drop in the room which could draw smoke and possibly fire from within the building to that particular unit to aggravate conditions there.

There have been numerous attempts in the prior art to provide air and oxygen supplies to persons trapped within such buildings. For example, U.S. Pat. No. 4,331,139 and U.S. Pat. No. 4,320,756 both present alternative designs of systems which might be used to supply air to a person trapped in a room in a burning building. Both of these patents attempt to utilize the air supply in the waste vents of a sewage pipe with a building. While these patents present a theoretical solution that may have practical merit in certain circumstances, the method proposed by the patents is not suitable for general application for there is a strong likelihood that the sewage system would become contaminated by toxic fumes and hot gases in the course of a fire. For example, the heat within the burning unit would soon evaporate the water from toilet fixtures and sink traps to allow the smoke and fumes to e drawn into the sewage pipes. Moreover, even if the sewer gas did not become contaminated by the smoke, the pipes could become heated by the fire to produce superheated gases which could burn the lungs of a person inhaling them. In any event, the gases ordinarily resident in the sewer system, while not fatally poisonous would likely cause some sickness if inhaled in quantity over a prolonged period of time.

SUMMARY OF THE PRESENT INVENTION

It is an object of the present invention to provide a system which permits a user to access air outside a burning building from within the building without breaking the pressure seal to any appreciable extent between building interior and exterior, so as to provide the user with a source of outside air to breathe until rescued.

It is also an object of this invention to provide an apparatus of a simple and cost-effective design which will include a signalling means to alert firemen to the fact that there is someone using the apparatus within the building generally, and even indicating the specific room or unit particularly.

Accordingly, the invention is an apparatus to allow a person within a room of a smoke-filled building to breathe air from outside the building, comprising in combination;

at least one conduit in an exterior building wall in communication with outside air, including a sealing device adapted to seal the conduit from the passage of air under ordinary conditions;

at least one tube connected at one end to at least one breathing mask, such breathing masks being adapted to permit the user to breathe air supplied by the tube and to exhale air into the room;

a coupling fixture adapted to permit operative connection of the mask tube to the conduit, and upon connection, to open the sealing device to permit the passage of air through the conduit as it is drawn into the tube and mask by the user.

The breathing apparatus above described will usually comprise a mask having an inlet port in communication with one end of said tube, and an outlet port in communication with the room. Each such port would be adapted with one-way valves to permit the inflow of air through the inlet port only, and to permit the exhaustion of air through the outlet port only.

It will be appreciated by persons skilled in the art that a number of one-way devices may be used to control the flow of air in and out of the face mask. Perhaps the simplest of these is simply a flap which overlays the hole and is permitted to open in one direction only because of its size in relation to the size of the port and its location (either on the interior of the mask in the case of the inlet port, or on the exterior of the mask in the case of the outlet port).

In preferred embodiments of this invention, the above described apparatus is used in combination with warning lights which may be placed on the exterior of the building, in the hallway, and/or in other suitable locations. In this combination, the successful connection of the mask tube and the conduit completes an electrical circuit which lights the exterior or other warning lights to indicate to firemen or other rescuers both occupancy and the fact that breathing apparatus are being used in certain rooms of the building. This facilitates the easy location and rescue of such people.

It will be apparent to those skilled in the art that a number of different types of conduits may be used to establish communication between an interior room and the outside air. Preferably, the conduit will be short and directly through the wall to an outside air source. In preferred embodiments of this invention the conduit is also fitted with filters being adapted to clean the air passing through the filter, in the event that there should be some smoke in the air outside the building. It will also be appreciated by persons skilled in the art that the conduit may be fitted with a thermal and vapor barrier and may be angled downward to prevent the collection and freezing of water within it. Particular designs of this invention to accommodate environmental design requirements in a variety of climates are within the state of the art and will be apparent to those skilled in the art.

For convenience of storage and for cosmetic reasons the apparatus of this invention may be installed in a box or cabinet located on a wall. The cabinet would be adapted to contain a sufficient quantity of masks, tubes and conduit connections to provide emergency breathing apparatus for the number of persons that might ordinarily be found in such unit of the building, with perhaps extras for other people driven from other units. The number, location and make up of emergency breathing stations is a matter of safety design which will be determined by regulation or design. The cabinet may be closed by a door or the like covered with a painting, a mirror, or a notice as to the procedure to be followed in a fire drill, whatever seems appropriate to the particular environment of the location. In a preferred embodiment of the invention, a light located on the interior of the door, for example, is actuable upon opening of the door to provide light to the interior of the cabinet. At the same time, a separate panel light is actuated (along with the exterior, hallway, and other warning lights) indicating successful connection of the mask tube to the conduit.

Connection of the mask tubes to the conduit is accomplished by the use of male and female jack couplings, the female jack coupling preferably mounted on the front face of a panel provided in the interior of the cabinet. The female jack coupling includes a one way flap valve element normally biased to a closed position, but openable upon insertion of a cooperating male jack coupling provided on the mask tube. At the same time, when the flap valve element is opened, it is pushed into engagement with a bus bar to establish an electrical circuit which actuates the previously described warning lights and panel light.

It will be further understood that the above described lights have their own separate power source so as to function in the event of a likely power outage or shutdown in the building during a fire.

It will thus be appreciated that the invention permits persons trapped in a burning building awaiting rescue to obtain fresh outside air without further aggravation of the fire conditions, while, at the same time, alerting others as to their presence, in an effective yet relatively simple and inexpensive manner.

Other objects and advantages will become apparent upon inspection of the accompanying drawings and detailed description which follows.

BRIEF DESCRIPTION OF THE DRAWINGS

FIG. 7 is a side view of the panel shown in FIG. 6;

FIG. 8 is a is a circuit diagram illustrating electrically, the connection of the one way valve connectors and a number of warning and other lights; and FIG. 9 illustrates an additional, optional indicator light in accordance with the invention.

DETAILED DESCRIPTION OF THE INVENTION

In the description of the preferred embodiments of this invention, like numerals indicate like elements in the various FIGURES of the drawings.

Figure 1:
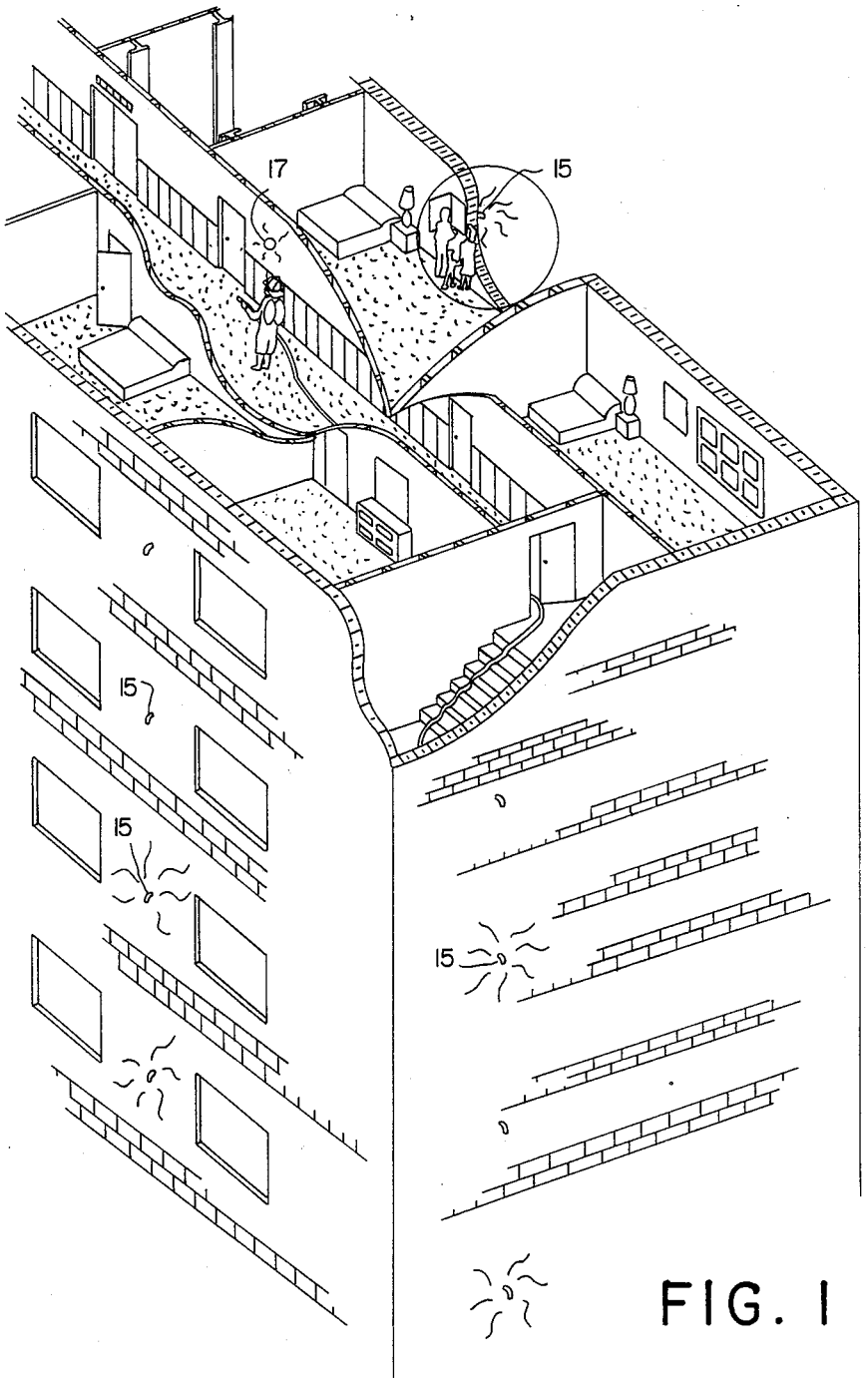
FIG. 1 is an illustration of a building fitted with the apparatus of this invention.

FIG. 1 illustrates a multiple-story building fitted with the apparatus of this invention. A family located in one unit of the building is shown using the apparatus of this invention to breathe outside air while a firefighter is searching the building to rescue people from the threat of suffocation or poisoning from smoke and toxic fumes. As illustrated, at each location of the building where people are using the apparatus of this invention, an exterior beacon lights up, indicating to firemen the exact floor in the building where people are located. A corridor light is also shown indicating the occupied unit on the particular floor.

Figure 2:
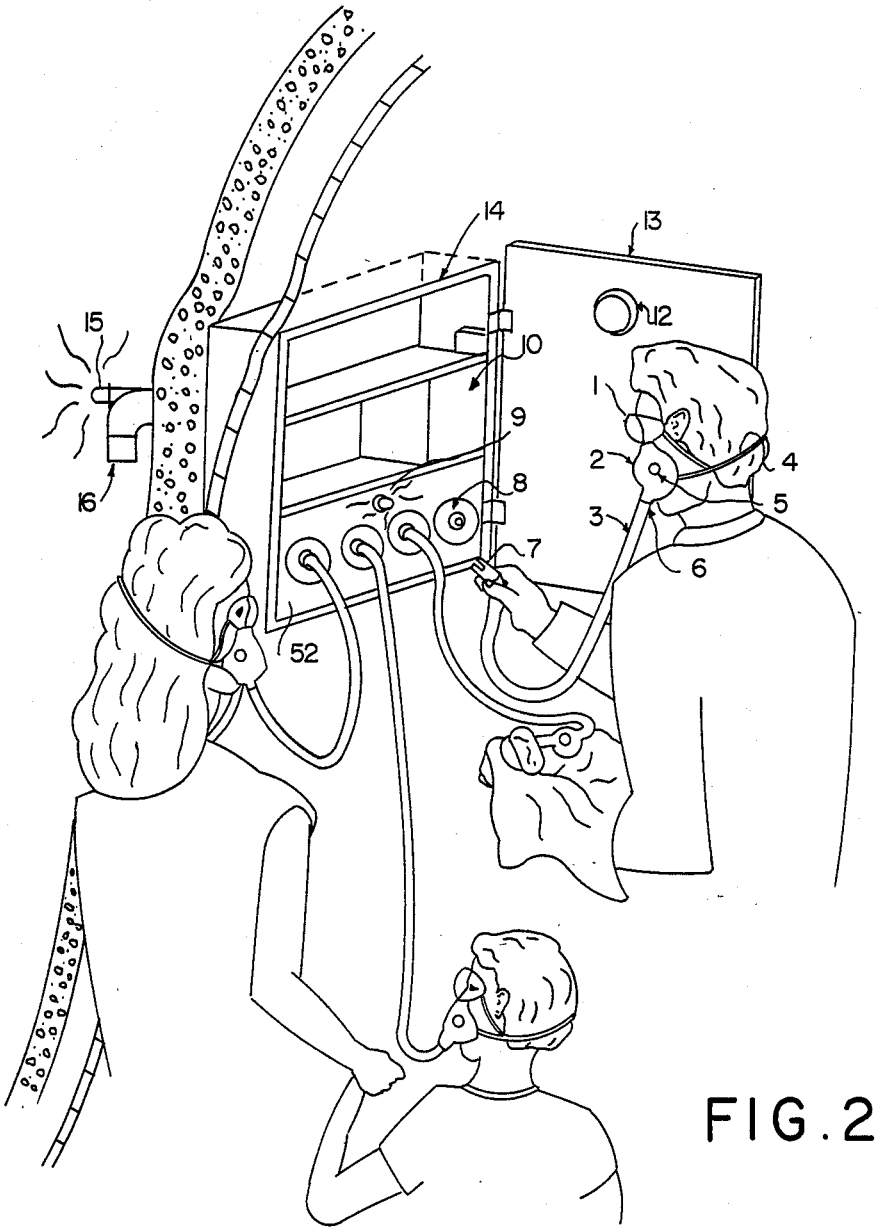
FIG. 2 is a schematic illustration of a group of people using the apparatus of this invention.

FIG. 2 illustrates how the invention is used, particularly in the event of a fire in the building. Users of the apparatus strap on a pair of goggles 1 and a face mask 2. The face mask is connected to a tube 3. The headgear is fitted about the head by means of an adjustable strap 4. The face mask has exhaust ports 5 and inlet ports 6.

The end of the tube away from the mask terminates in a male coupling jack 7 which is adapted to be fitted into a female coupling jack 8 provided in a panel of a wall mounted cabinet 14. The female coupling jack includes a one way flap valve in communication with a supply of fresh air as described in greater detail hereinbelow. A panel light 9, adjacent the female couplings 8, flashes to indicate that a proper connection has been made to the conduit and that electrical connection has also been completed to activate an exterior flashing beacon 15, and a corridor or hallway light 17 to alert the fire department personnel and/or other rescuers as to their presence.

It will be appreciated that additional warning lights, buzzers, or the like may be incorporated into the circuit for remote warning or signalling, for example, at a centrally located building control panel.

Also illustrated in FIG. 2 is a portion of the filter housing 16 of the exterior conduit which will be described in more detail with reference to FIG. 3.

The goggles, face mask and tubing are contained in the cabinet 14 having a door 13 and a door light 12 on its interior. The light 12 is activated, by an alternate power source to light up the interior of cabinet 14 when door 13 is opened. Power to activate the exterior and interior warning lights, panel light, and cabinet door light is preferably supplied by a battery pack and a conventional recharging device located, for example, within the cabinet 14 in a box 10. The self-contained alternate source of power, while not essential, is an added advantage where there is a power failure in the building at the time of the emergency.

Figure 3:
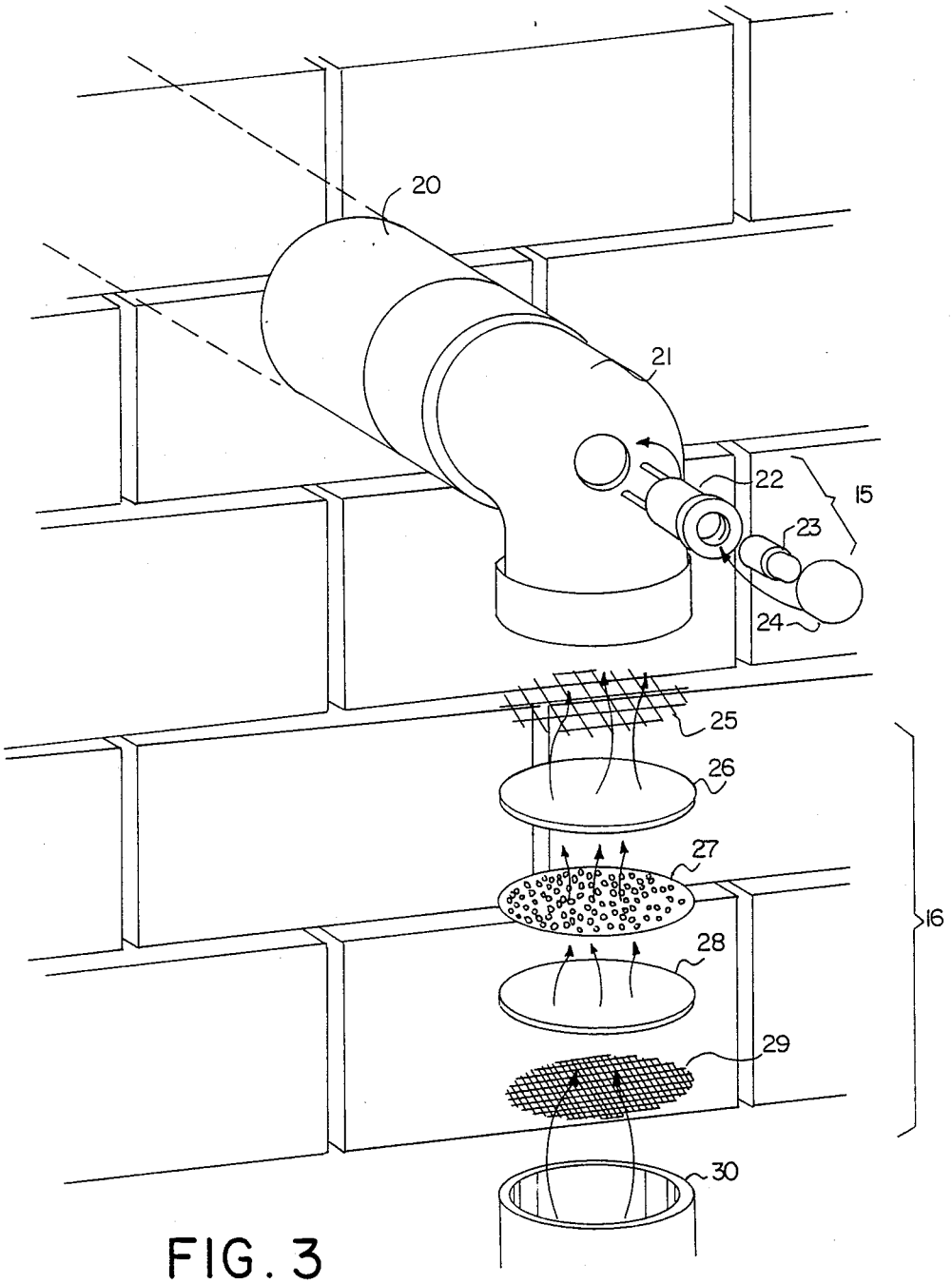
FIG. 3 is an illustration of the outside portion of the conduit of the apparatus of this invention.

FIG. 3 illustrates the preferred embodiment of the external portion of the conduit 20 which acts as a duct to communicate between the exterior of the building and the interior of cabinet 14. As shown, the end portion 21 depends downwardly to avoid plugging with water ice or other debris. In the illustrated embodiment the flashing external beacon 15 is contained at the end of the downward depending portion of the conduit 21. The beacon comprises a socket 22 electrically connected within the conduit 21, a light bulb 23 and a protective lens cover 24. The closer the beacon is to the unit the less likely will be interception of the electrical signal by the fire.

Within the filter section 16 are an internal screen mesh 25, particle filters 26 and 28 and charcoal filter 27, followed by external screen mesh 29 and the filter cap 30. The screens and the filters are adapted to fit in the downwardly depending opening of the end portion 21 and to be retained by the filter cap 30. The filter section is adapted to clean the air before it is drawn into the conduit for breathing. The filtering mechanism may be varied in accordance with predeterminations of possible contaminants. The design of the filter is beyond the scope of this invention and is within the scope of the art of filtration devices.

Figure 4:
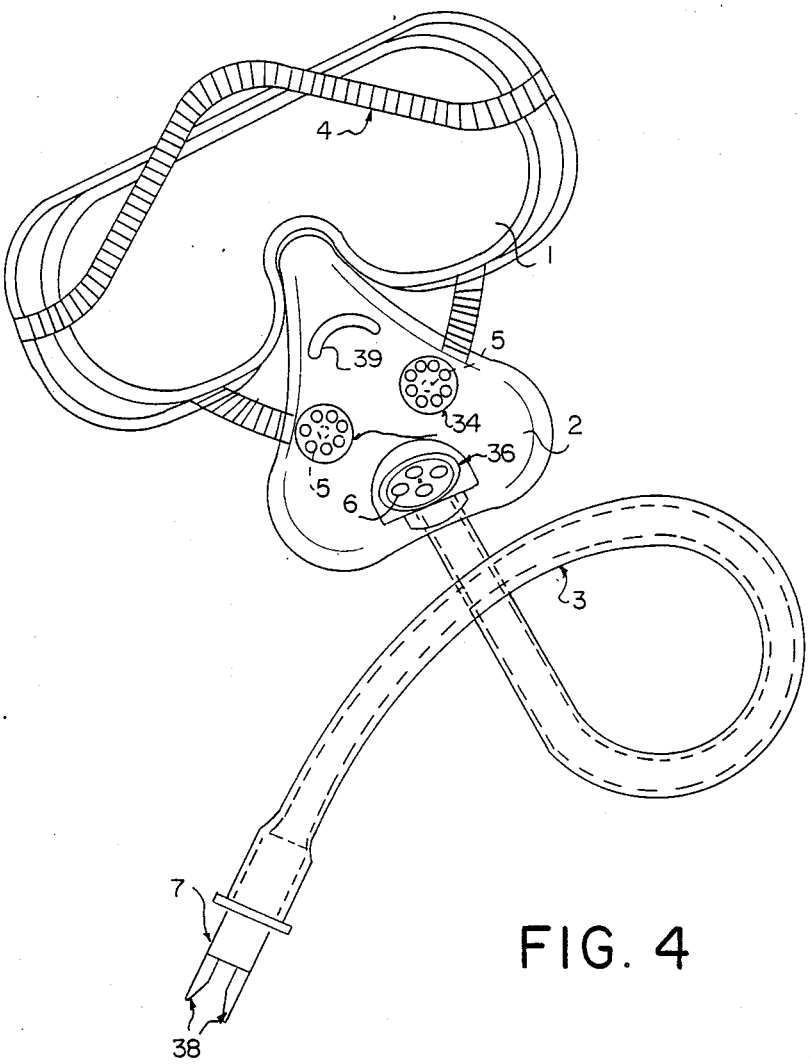
FIG. 4 is a perspective view of a mask, tube and coupling element in accordance with one embodiment of the invention.

FIG. 4 illustrates one embodiment of a breathing headpiece in accordance with the invention. In particular, two exhaust ports 5 are provided in the face mask 2 with external flaps or diaphragms 34 being adapted to prevent air from or inhaled through the ports but permitting air to be exhausted therefrom. Similarly, inlet port 6 between the tube and the mask is covered by an interior flap or diaphragm 36 which permits air to be drawn from the tube, but not to be exhaled into the tube. The male coupling jack 7 at the end of the tube 3 is fitted with prongs 38 which are received in a complimentary female coupling jack 8 as hereinafter described. Associated goggles 1 with a flexible, resilient headband 4 are also shown.

Figure 5:
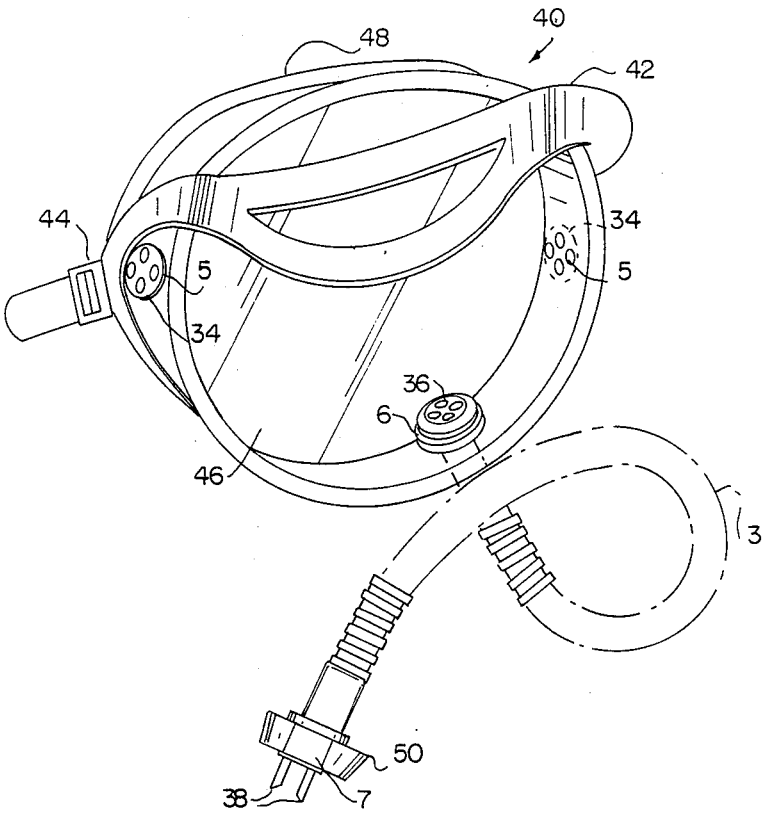
FIG. 5 is a perspective view of an alternative mask, tube and coupling element in accordance with another embodiment of the invention.

FIG. 5 illustrates an alternative headgear construction wherein, essentially, the goggles and face mask components of the FIG. 4 embodiment are combined in a single, scuba-type mask 40. As in the previous embodiment, inlet port 6 is covered by an interior diaphragm 36 and outlet ports 5 are covered by exterior diaphragms 34.

A flexible headstrap 42 is connected to either side of the mask, and is adjustable by way of buckle 44. The mask itself is provided with a tempered glass face plate 46 surrounded by a stainless steel pressure seal 48.

Hose or tube 3, connected at one end to the inlet port 6, is also provided with a male coupling jack 7 at its other end including prongs 38. In this embodiment, the male jack coupling is further provided with an annular foam rubber seal 50 which eliminates any possibility of inside air entering the hose 3 at the interface with female coupling jack 8.

The mask may also be provided with vent means to prevent fogging of the face plate.

Figure 6:
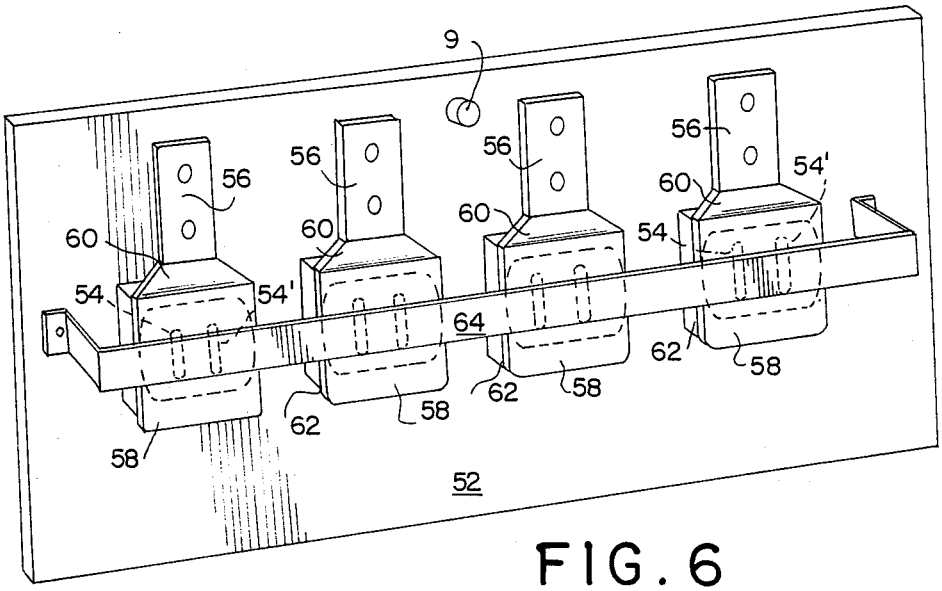
FIG. 6 is a rear view of a cabinet panel provided with one way valve connectors in accordance with an exemplary embodiment of the invention.

Referring now to FIGS. 6 and 7, a number of female jack couplings 8 are shown mounted in a panel 52 of the cabinet 14. Panel 52 is preferably constructed of plastic or other electrically insulated material. Each female jack coupling 8 includes a pair of entry slots 54, 54' which are sized to snugly receive the prongs 38 provided on the male jack coupling members 7. On the rear face of the panel 52, spring steel flap valve elements 56 are secured by boltsor other suitable means. Each flap valve element includes an offset portion 58 and associated integral hinge portion 60. The offset portion 58 has mounted thereon a foam rubber seal 62 which, by reason of the inherent springiness of the valve element 56, is normally biased into engagement with the rear face of the female jack coupling 8 so as to create an air tight seal around the apertures or slots 54, 54'.

Upon insertion of a male jack coupling 7, prongs 38 will force the seal 62 and offset 58 of the valve 56 to pivot away from the apertures 54, 54' about the integral hinge portion 60, thereby establishing communication between the outside air in conduit 20 and the headgear inlet tube 3.

A bus bar 64 is mounted to the rear face of the electrically insulated panel 52, and is configured so as to straddle the group of above described flap valve elements 56. Thus, upon opening of any of the valves, the offset portion 58 thereof comes into contact with bus bar 64.

The purpose for the bus bar is more fully explained with further reference to FIG. 8 which illustrates an electrical circuit diagram which activates the various warning and panel lights upon insertion of one or more male jack couplings 7 into respective female jack couplings 8.

Specifically, a battery power pack 66 (which may be located in box 10 inside the cabinet 14) including, for example, four, rechargeable "C-cell" batteries, includes two terminals, one of which is connected to each of the electrically conductive offset portions 58 of the flap valve elements 56. The other terminal is in electrical contact with one contact of each of the panel light 9, exterior warning light 15 and corridor light 17 which are connected in parallel. The other contact of the lights 9, 15 and 17 is in electrical contact with the bus bar 64. Thus, a complete circuit is established only when one or more of the valve portions 58, which in effect constitute switches, comes into contact with the bus bar 64.

A separate electrical circuit, also connected to power pack 66, is established across a switch 68 which is closed only when the door 13 of the cabinet 14 is opened. This circuit includes the light 12 mounted on the interior of the door for illuminating the interior of the cabinet when the door is opened.

For ease of replacement of the batteries in the power pack 66, a jack arrangement 70 may be utilized to connect the power pack to the cabinet circuit.

Referring now to FIG. 9, an additional indicator light 72 may also be utilized in conjunction with the present invention. Light 72 is preferably mounted on the exterior of the cabinet, which as previously mentioned may be "disguised" or otherwise decorated, so as to alert potential users of the presence of the breathing apparatus in that cabinet. This light would preferably be operated continuously, and therefore, has its own independent battery pack 74 and associated jack coupling 76.

It will be understood that for any or all of the above-described lights, with perhaps the exception of cabinet door light 12, conventional "flasher" devices, such as that illustrated at 78 in FIG. 9, may be utilized to cause the lights to flash on and off to create a greater visual impact which is oftentimes desirable in emergency situations.

In operation of this invention, persons trapped in a smoke-filled building would open the door of the cabinet 14 which would turn on light 12 to illuminate the cabinet interior. Each person would remove a face mask and tube from the cabinet and plug the male jack coupling 7 into a respective female jack coupling 8. The beacon light in the cabinet 14 and outside the building would begin flashing. The persons would breathe outside filtered air until firemen located them via the beacon and led them to safety.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

I claim:

1. Breathing apparatus for providing outside air to at least one person in a room of a building including an exterior wall comprising:

conduit means having first and second ends, adapted to extend directly through the exterior wall of the building for establishing direct communication between the room of the building at the first end and the outside air at the second end;

valve means in said conduit means for normally preventing the outside air from passing through said conduit means into the room;

at least one breathing mask having an air supply tube said air supply tube having one end connected to said mask and an opposite, free end;

coupling means for operatively connecting the free end of said air supply tube to the first end of said conduit means;

said coupling means including means for opening said valve means upon said connecting of said air supply tube and said conduit means to permit the supplying of the outside air through said conduit means and said air supply tube into said mask and said mask including means for selectively permitting the person to breathe the outside air supplied by said air supply tube and to exhale exhaust air into the room.

2. The breathing apparatus of claim 1 in which said mask has at least one inlet port in communication with the one end of supply tube, said means for selectively permitting the person to breathe the outside air supplied by said air supply tube includes one-way valve means positioned in said inlet port, and said one-way valve means of said inlet port prevents the person from exhaling the exhaust air through said inlet port.

3. The breathing apparatus of claim 2 in which said mask has at least one said outlet port means for said permitting the person to exhale exhaust air into the room includes one-way valve means positioned in said outlet port, and said one-way valve means of said outlet port prevents any air from entering into said mask through said outlet port.

4. The breathing apparatus of claim 1 and further including beacon means mounted at a remote location for indicating the person is in the room and means for activating said beacon means upon said connecting of said air supply tube and said conduit means in the room.

5. Apparatus for supplying at least one person trapped in a smoke-infested interior of a room of a building having an exterior wall with outside air for breathing, said apparatus comprising:

conduit means having first and second ends, for extending directly through wall of the building to establish direct communication between the interior of the room of the building at the first end and the outside air at the second end;

at least one sealing valve means for allowing passage of the outside air through said conduit means when opened and for preventing the passage of the outside air through said conduit means when closed to maintain a pressure difference between the interior of the room and the outside air around the building;

said at least one valve means having first coupling means at the first of conduit means;

at least one breathing mask having an inlet port;

at least one air supply tube having a first end and a second end;

said first end being connected to said inlet port of said at least one mask said second end of said at least one air supply tube having second coupling means;

said second coupling means being adapted for connection to said first coupling means of said at least one valve means to open said at least one valve means to allow the passage of the outside air through said conduit means and into said at least one air supply tube to thereby supply the outside air to said at least one breathing mask through said conduit means and said at least one air supply tube.

6. The apparatus of claim 5 in which said inlet port includes one-way valve means which permits the person to draw the outside air into said at least one mask through said conduit means and said at least one air supply tube and prevents air being exhaled by the person form passing into said at least one air supply tube.

7. The apparatus of claim 6 in which said mask includes outlet port means including one-way valve means which permits air to be exhausted from said at least one mask through said outlet port means and prevents air from entering said at least one mask through said outlet port means.

8. Apparatus as defined in claim 5 and further including a plurality of indicator light adapted to be located on the building remote from the interior of the room and means for activating said plurality of indicator lights upon connection of said first and said second coupling means.

9. Apparatus as defined in claim 8 wherein said means for activating said plurality of indicator lights includes a battery pack.

10. Apparatus as defined in claim 5 wherein said valve means comprises at least one spring steel flap element which is normally biased into engagement with said first coupling mans when closed and is displaced from said engagement to be open when said second coupling means is connected to said first coupling means.

11. Apparatus as defined in claim 9 wherein said flap element includes foam rubber seal means to provide said engagement with said first coupling means for establishing an air tight seal between said conduit means and said first coupling means.

12. Apparatus as defined in claim 9 further including a plurality of said valve means and a cabinet enclosing the plural said first coupling means.

13. Apparatus as defined in claim 11 and further including at least one remotely mounted warning light means for indicating the person is in the room and means for activating said warning light means by said connection of said first and said second coupling means.

14. Apparatus as defined in claim 13 wherein said means for activating includes an electrical circuit to said warning light means, said electrical circuit is normally open and can be closed for supplying electricity to said warning light means said electrical circuit includes an electrically conductive bus bar mounted adjacent said flap elements, and any one of said valve means when open causes engagement of an associated one of said flap elements with said bus bar to close said electrical circuit for supplying said electricity to said warning light means.

15. Apparatus as defined in claim 14 wherein said means for activating includes a self-contained power pack mounted in said cabinet for supplying power to said warning light means.

16. Apparatus as defined in claim 5 wherein at least one of said first and said second coupling means includes foam rubber seal means for establishing an air tight seal with the other of said first and said second coupling means.

17. Breathing apparatus for providing outside air to at least one person in a room of a building including an exterior wall comprising:

conduit means, having first and second ends, extending directly through the exterior wall of the building for establishing direct communication between the room of the building at the first end and the outside air at the second end;

valve means in the conduit means for preventing the outside air from passing through the conduit means into the room;

at least one breathing mask having an air supply tube;

said air supply tube having one end connected to said mask and an opposite, free end;

coupling means for operatively connecting the free end of said air supply tube to the first said conduit means;

said coupling means including means for opening said valve means upon connecting of said air supply tube and said conduit means to permit the supplying of the outside air through said conduit means and said air supply tube into said mask;

said mask including means for selectively permitting the person to breathe the outside air supplied by said air supply tube and to exhale exhaust air into the room;

at least one remotely mounted warning light means for indicating the person is in the room; and means for activating said warning light means upon said connecting of said air supply tube and said conduit means when said coupling means opens said valve means.

* * * * *

UNITED STATES PATENT AND TRADEMARK OFFICE

CERTIFICATE OF CORRECTION

PATENT NO. : 4,905,684

DATED : March 6, 1990

INVENTOR(S) : George R. HEFFER

It is certified that error appears in the above-identified patent and that said Letters Patent is hereby corrected as shown below:

In column 1, line 8, delete "abandaned", and insert --abandoned--.

In column 1, line 61, delete "e", and insert --be--.

In column 4, line 56, after "activated", delete the ",".

In column 5, line 27, delete "or", and insert --being--.

In column 5, line 65, delete "boltsor", and insert --bolts or--.

In Claim 5, column 7, line 63, after "through", insert --the exterior--.

In Claim 6, column 8, line 27, delete "form", and insert --from--.

In Claim 10, column 8, line 46, delete "mans", and insert --means--.

In Claim 12, column 8, line 57, delete "plural said first coupling means", and insert --plurality of said first coupling means--.

In Claim 17, column 10, line 8, after "first", insert --end of--.

Signed and Sealed this

Fourth Day of June, 1991

*Attest:*

HARRY F. MANBECK, JR.

*Attesting Officer*

*Commissioner of Patents and Trademarks*